US011213939B2

(12) United States Patent
Kosa et al.

(10) Patent No.: US 11,213,939 B2
(45) Date of Patent: Jan. 4, 2022

(54) CHISEL

(71) Applicant: Hilti Aktiengesellschaft, Schaan (LI)

(72) Inventors: Zsolt Kosa, Buchs (CH); Aviral Shrot, Lindau (DE); Carsten Peters, Sax (CH); Attila Kenez, Kecskemet (HU)

(73) Assignee: Hilti Aktiengesellschaft, Schaan (LI)

( * ) Notice: Subject to any disclaimer, the term of this patent is extended or adjusted under 35 U.S.C. 154(b) by 184 days.

(21) Appl. No.: 16/084,058

(22) PCT Filed: Mar. 21, 2017

(86) PCT No.: PCT/EP2017/056617
§ 371 (c)(1),
(2) Date: Sep. 11, 2018

(87) PCT Pub. No.: WO2017/162623
PCT Pub. Date: Sep. 28, 2017

(65) Prior Publication Data

US 2020/0122309 A1 Apr. 23, 2020

(30) Foreign Application Priority Data

Mar. 23, 2016 (EP) ..... 16161839

(51) Int. Cl.
*B25D 17/02* (2006.01)

(52) U.S. Cl.
CPC ..... *B25D 17/02* (2013.01); *B25D 2250/211* (2013.01)

(58) Field of Classification Search
CPC ..... B25D 17/02; B25D 17/04; B25D 1/02; B25D 3/00; B25D 2250/211; B28D 1/26; B28D 1/265; A61B 17/1604
USPC ..... 125/41; 30/167, 167.1, 167.2
See application file for complete search history.

(56) References Cited

U.S. PATENT DOCUMENTS 751,403 A * 2/1904 Norton ..... B27F 5/12 30/167.1
1,243,504 A * 10/1917 Furber ..... B25D 3/00 30/167
2,028,993 A * 1/1936 Pollard ..... B25D 17/02 30/168
5,088,863 A 2/1992 Imanaga et al.
(Continued)

FOREIGN PATENT DOCUMENTS

CN 201922428 U 8/2011
CN 103313668 A 9/2013
(Continued)

*Primary Examiner* — Orlando E Aviles
*Assistant Examiner* — Robert F Neibaur
(74) *Attorney, Agent, or Firm* — Davidson, Davidson & Kappel, LLC

(57) ABSTRACT

The chisel includes a tip (2), a working section (6), and an impact surface (3), and a longitudinal axis (7) that extends through the tip (2), the working section (6), and the impact surface (3). The working section (6) includes multiple webs (14) that extend along the longitudinal axis (7) and that are distributed about the longitudinal axis (7) in the circumferential direction (15). For at least one of the webs (14), a dimension (27) in the circumferential direction (15) increases by at least one-third with increasing distance (26) from the longitudinal axis (7). The webs become significantly wider toward the outside and thinner toward the longitudinal axis.

16 Claims, 2 Drawing Sheets

(56) References Cited

U.S. PATENT DOCUMENTS

| | | | | |
|---|---|---|---|---|
| 6,981,496 | B2 | 1/2006 | Szendrovari et al. | |
| 7,628,232 | B2 | 12/2009 | Koch et al. | |
| 9,085,074 | B2 | 7/2015 | Quinn et al. | |
| 9,221,164 | B2 | 12/2015 | Schneider et al. | |
| 9,737,318 | B2 | 8/2017 | Monstadt et al. | |
| 2013/0205603 | A1 | 8/2013 | Schneider et al. | |
| 2020/0223047 | A1 * | 7/2020 | Moan | B23B 51/0406 |

FOREIGN PATENT DOCUMENTS

| | | | | |
|---|---|---|---|---|
| DE | 463571 | C | 8/1928 | |
| DE | 685529 | C | 12/1939 | |
| DE | 828385 | C | 1/1952 | |
| DE | 1846211 | U | 2/1962 | |
| DE | 3127740 | A1 | 2/1982 | |
| DE | 19914522 | A1 | 10/2000 | |
| DE | 10057124 | A1 * | 5/2001 | B25D 17/02 |
| DE | 3853518 | T3 | 6/2004 | |
| DE | 202013003876 | U1 | 6/2013 | |
| EP | 1849955 | | 10/2007 | |
| GB | 512830 | | 9/1939 | |

* cited by examiner

CHISEL

The present invention relates to a chisel, in particular a pointed chisel, for breaking up mineral building materials, for example concrete.

BACKGROUND

Pointed chisels with a punctiform tip are known from U.S. Pat. Nos. 6,981,496, 9,221,164, 9,085,074, CN 201922428 U, DE 1846211 U, DE 202013003876 U1, DE 19914522 A1, DE 828385 A, and DE 463571 A, for example. The chisels are driven into a substrate with the aid of a pneumatic or electropneumatic chipping hammer. The chisel must be resistant to the impact forces, tensile forces, and transverse forces that occur. Although enlarging the cross section or the core diameter increases the stability, the mass of the chisel thus also increases, as the result of which a more powerful chipping hammer is necessary.

SUMMARY OF THE INVENTION

The chisel according to the present invention includes a tip, a working section, and an impact surface, and a longitudinal axis that extends through the tip, the working section, and the impact surface. The working section includes multiple webs that extend along the longitudinal axis and that are distributed about the longitudinal axis in the circumferential direction. For at least one of the webs, a dimension in the circumferential direction increases by at least one-third, for example by at least one-half or by at least three-fourths, with increasing distance from the longitudinal axis. The webs become significantly thinner toward the longitudinal axis and therefore significantly wider toward the outside. A widest point is at least one-third wider than the narrowest point. The chisel allows a design with a low mass, in particular a small core, while still achieving the required mechanical stability.

In one embodiment, the core contributes less than one-third to the mass of the working section; i.e., its circular area is less than one-third of the cross-sectional area through the working section. A height of the webs is preferably at least one-half the core diameter; i.e., the ratio of the outer diameter of the working section to the core diameter is greater than 2:1, preferably greater than 5:2. The grooves that extend between the webs are recessed at an appropriate depth in the chisel.

One specific embodiment provides that the at least one web includes a first lateral surface pointing in a circumferential direction, and a second lateral surface pointing opposite the circumferential direction. The first lateral surface and the second lateral surface are inclined relative to one another, and diverge from one another with increasing distance from the longitudinal axis. The lateral surfaces preferably point predominantly in the circumferential direction; i.e., the perpendicular to the lateral surfaces and the circumferential direction enclose an angle of less than 45 degrees. The inclined lateral surfaces together may form one-third of the total surface of the web; for example, the first lateral surface may form at least one-sixth of the surface of the web, and/or the second lateral surface may form at least one-sixth of the surface of the web.

For the at least one web, an angular dimension about the longitudinal axis in the circumferential direction may remain the same or increase with increasing distance from the longitudinal axis.

One specific embodiment provides that the working section includes at least three webs. The webs may be distributed at identical angular intervals about the longitudinal axis.

One specific embodiment provides that an inclination of the webs relative to the longitudinal axis is less than 10 degrees. The webs may extend circumferentially about the longitudinal axis by less than 90 degrees.

One specific embodiment provides that the webs have an undulated design. An inclination, averaged over the longitudinal axis, is preferably less than 5 degrees.

One specific embodiment provides that a groove is situated between two adjacent webs. In the direction toward the longitudinal axis, the groove has a continuously decreasing dimension in the circumferential direction. The oppositely situated lateral surfaces of the webs are inclined relative to one another, preferably at an angle of greater than 10 degrees, preferably greater than 20 degrees. The webs may be produced by rolling or impressing of the grooves.

BRIEF DESCRIPTION OF THE DRAWINGS

The following description explains the present invention with reference to exemplary specific embodiments and figures.

Unless stated otherwise, identical or functionally equivalent elements are indicated by the same reference numerals in the figures. The cross sections are four times larger than illustrated in FIG. 1.

DETAILED DESCRIPTION

Figure 1:
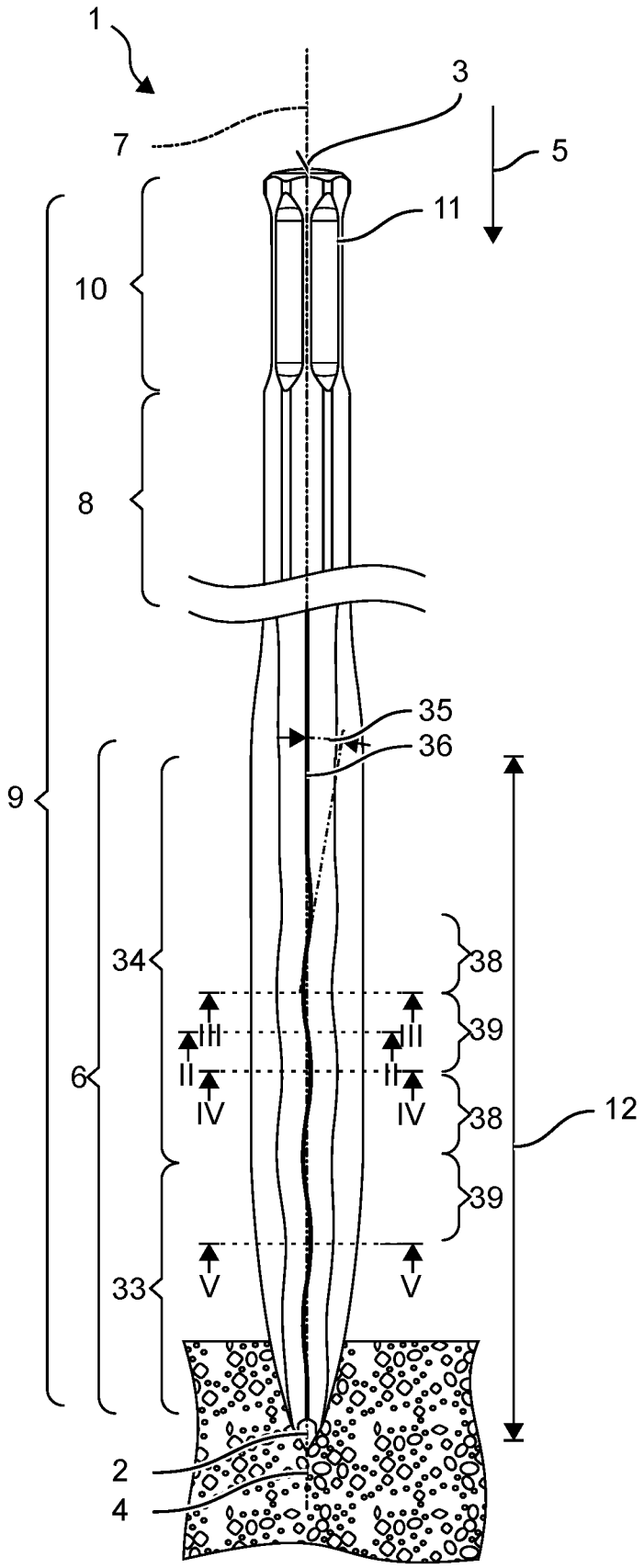
FIG. 1 shows a chisel.
Figure 2:
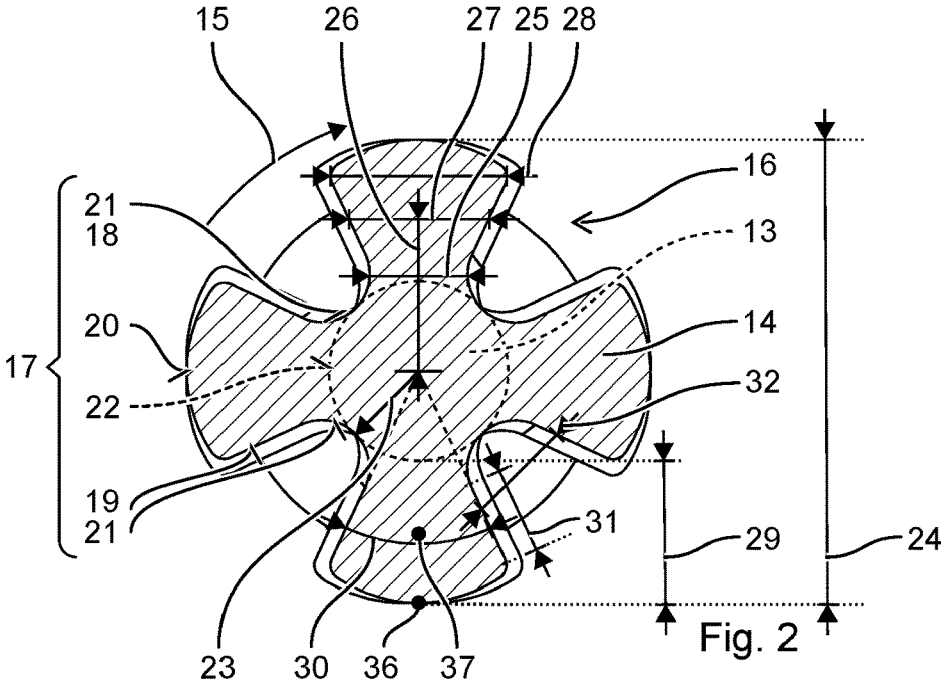
FIG. 2 shows a cross section in plane II-II.
Figure 3:
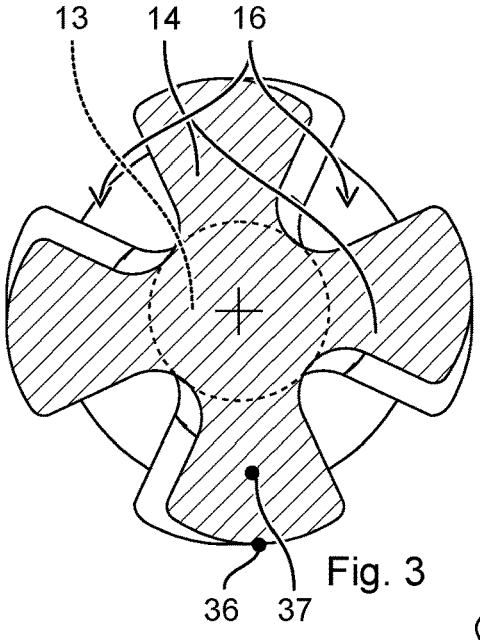
FIG. 3 shows a cross section in plane
Figure 4:
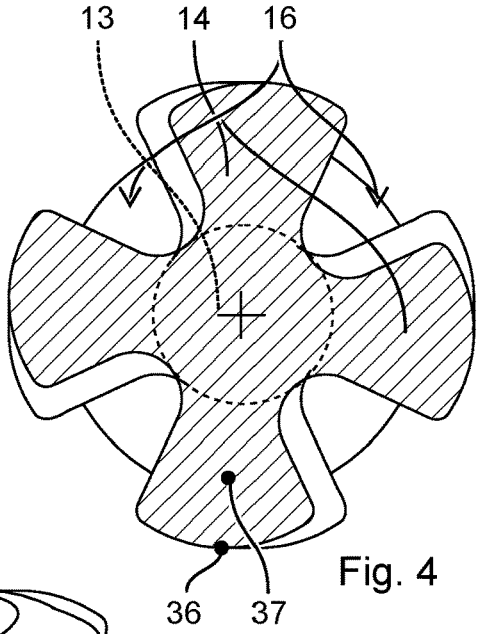
FIG. 4 shows a cross section in plane IV-IV.
Figure 5:
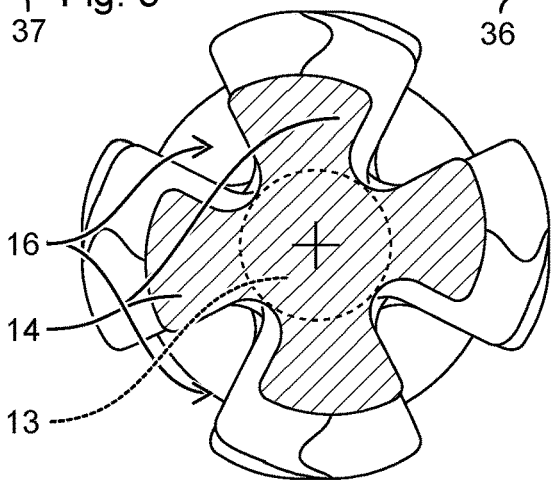
FIG. 5 shows a cross section in plane V-V.

FIG. 1 shows a side view of an example of a chisel 1 for removing concrete, rock, or other mineral building materials. Chisel 1 includes a tip 2 on one end, and an impact surface 3 on an end facing away from tip 2. Chisel 1 is placed with its tip 2 against a substrate 4. A striking mechanism of a machine tool strikes impact surface 3 of chisel 1 in an impact direction 5. As a result, tip 2 is driven into substrate 4 in impact direction 5. A working section 6 adjoining tip 2 spreads substrate 4 apart radially until substrate 4 breaks due to the tension.

Chisel 1 is an essentially rod-shaped body overall. Chisel 1 has a longitudinal axis 7 that extends through tip 2 and impact surface 3. The following spatial descriptions "axial," "radial," "radial direction," and "circumferential direction" refer to this longitudinal axis 7. The radial direction has its origin in longitudinal axis 7, and points outwardly. The largest dimension of chisel 1 is typically along longitudinal axis 7; the dimensions perpendicular to longitudinal axis 7 are much smaller.

Chisel 1, starting from impact surface 3, includes an impact surface 3, a shank 8, a working section 6, and tip 2 situated in succession along longitudinal axis 7. Chisel 1 is described below subdivided into multiple parts that have certain geometric or functional differences. However, the parts preferably form a monolithic body without joint zones; this applies in particular for base body 9, which is made up of shank 8 and working section 6. Base body 9 is made of a steel, and the parts are not joined, i.e., not welded, soldered, screwed, etc. Tip 2 may be manufactured together with base body 9 in a monolithic design.

The example of chisel 1 is a so-called pointed chisel. Chisel 1 has one tip 2 that is situated on longitudinal axis 7. Tip 2 essentially has the shape of a solid of revolution; for example, tip 2 is conical, dome-shaped, or pyramidal. The mutually orthogonal dimensions of tip 2 in the planes perpendicular to longitudinal axis 7 are approximately equal. The mutually orthogonal dimensions preferably differ from one another by less than one-third.

Shank 8 is a rod-shaped body. A longitudinal axis of shank 8 coincides with longitudinal axis 7 of chisel 1; i.e., shank 8 is coaxial with respect to longitudinal axis 7. Illustrated shank 8 is prismatic, with a hexagonal cross section. Prismatic shank 8 may have a cross section that is square, hexagonal, octagonal, circular, or elliptical, among other shapes.

Impact surface 3 is formed by an end-face side of shank 8 of chisel 1. Impact surface 3 is oriented essentially perpendicularly relative to longitudinal axis 7. Impact surface 3 may have a convex or flat design.

An insertion end 10 directly adjoins impact surface 3. Insertion end 10 is inserted into a tool holder of the machine tool. Insertion end 10 may be provided with structures that are used to secure chisel 1 in the tool holder. For example, insertion end 10 includes one or multiple locking grooves 11 that are closed on both sides along longitudinal axis 7. Locking grooves 11 have a length of 1 cm to 4 cm, for example. An annular collar may be provided instead of or in addition to locking grooves 11.

Working section 6 is a continuous rod-shaped body. A longitudinal axis of working section 6 coincides with longitudinal axis 7 of chisel 1; i.e., working section 6 is coaxial with respect to longitudinal axis 7. The largest dimension of working section 6, its length 12, is preferably situated along longitudinal axis 7; the dimensions transverse to longitudinal axis 7 are much smaller than length 12, for example one-third at most.

Working section 6 includes a cylindrical core 13 and multiple webs 14. Webs 14 extend over entire length 12 of working section 6. Webs 14 are distributed around core 13 in circumferential direction 15. A groove 16 is situated in each case between adjacent webs 14 in circumferential direction 15. The arrangement of webs 14 over entire length 12 results in a star-shaped cross-sectional profile, as illustrated in FIGS. 2 through 5 for the example of chisel 1 in FIG. 1.

The surface of working section 6 is made up of surface 17 of webs 14. The surface illustrated by way of example is formed by the four webs 14 and their surfaces 17. Webs 14 completely enclose core 13 situated on longitudinal axis 7.

Surface 17 of web 14 has two lateral surfaces 18, 19 that face away from one another, and a rear surface 20. Lateral surfaces 18, 19 and the rear surfaces extend along longitudinal axis 7; i.e., the largest dimension of lateral surfaces 18, 19 and of rear surface 20 is along longitudinal axis 7. A first of lateral surfaces 18 points predominantly in circumferential direction 15; a second of lateral surfaces 19 points predominantly opposite circumferential direction 15. Rear surface 20 points predominantly in the radial direction. A perpendicular to a point on surface 17 may be split in a customary manner into a vector portion in the radial direction and a vector portion in circumferential direction 15. In this context, this essentially means that the vector portion having the greater absolute value determines the direction in which surface 17 points at the point. Surface 17 may include transition surfaces 21 that join together lateral surfaces 18, 19 of adjacent webs 14. Transition surfaces 21 form the base of grooves 16. Transition surfaces 21 may point predominantly in the radial direction.

Webs 14 have a uniform or essentially uniform cross section along longitudinal axis 7. The cross section is specified by lateral surfaces 18, 19 and rear surface 20 of web 14. The overall surface of working section 6 is correspondingly specified solely by webs 14.

Web 14 by way of example has an essentially trapezoidal cross section. Rear surface 20 forms one of the base sides; lateral surfaces 19 form the legs. Rear surface 20 may be convexly curved. Lateral surfaces 19 by way of example may be flat. An imaginary base surface 22 situated opposite from rear surface 20 forms the other of the base sides. Base surfaces 22 connect, for example, the lowest points of grooves 16. Imaginary base surfaces 22 of webs 14 enclose core 13.

Core 13 is preferably the largest convex prismatic body that can be situated within the surface of working section 6. Core 13 contacts grooves 16 at their points closest to longitudinal axis 7, i.e., at their lowest points. For symmetrical arrangements of webs 14, core 13 is a circular cylinder that contacts all grooves 16. A radius 23 of core 13 is equal to the radial distance of grooves 16 from longitudinal axis 7. The core diameter is twice radius 23.

Core 13 constitutes a small portion of the mass of working section 6. The core diameter is preferably less than one-half of outer diameter 24 of working section 6, for example less than 40% of outer diameter 24. The cross-sectional area of core 13 constitutes less than one-third of the total cross-sectional area, for example less than one-fourth. Webs 14 correspondingly contribute to at least two-thirds of the cross-sectional area and of the mass of working section 6.

Web 14 has a constriction with smallest dimension 25 in circumferential direction 15. The constriction is preferably close to core 13. Web 14, starting from the constriction, becomes wider with increasing distance 26 from longitudinal axis 7. Dimension 27 preferably increases continuously in circumferential direction 15. Dimension 27 in circumferential direction 15 refers to the distance, in a linear measure, between lateral surfaces 18, 19, facing away from one another, at the particular radial distance 26 from longitudinal axis 7. The widest point (shoulder) with largest dimension 28 in circumferential direction 15 adjoins rear surface 20. The ratio of the shoulder to the constriction is very pronounced. The shoulder is at least one-third wider than the constriction, preferably one-half, for example three-fourths, wider. The dimension in circumferential direction 15 preferably increases over a majority of height 29 (radial dimension) of web 14, at least over one-half of height 29. Dimension 27 in circumferential direction 15 may increase from the constriction in the direction of core 13.

Lateral surfaces 18, 19 are inclined relative to one another and are spaced apart from one another, viewed from core 13. An imaginary section line of inclined lateral surfaces 18, 19 is situated on the side of base surface 22, preferably within core 13. The two lateral surfaces 18, 19 of the four webs 14 enclose an angle 30 between 33 degrees and 54 degrees. For a number of N webs 14, angle 30 may be selected, for example, to be between 75% of 180/N degrees and 120% of 180/N degrees.

Mutually inclined lateral surfaces 18, 19 constitute a predominant portion of surface 17 of webs 14. The two lateral surfaces 18, 19 together form at least one-half of total surface 17. Lateral surfaces 18, 19 are inclined relative to one another over a significant portion of height 29 of web 14 in the above-described manner. For example, lateral surfaces 18, 19 are inclined relative to one another in this way for at least one-half, for example at least three-fourths, of height 29 of web 14. Distance 31 of the constriction from the widest point may be greater than one-half of height 29, for example greater than three-fourths of height 29.

Web 14 is much wider at rear surface 20 than at base surface 22. The smallest width is, for example, between 20% and 75% of the largest width. Height 29 refers to the largest dimension in the radial direction of webs 14. Height 29 may be determined as the difference between the radial distance of rear surface 20 from longitudinal axis 7 and the radial distance of groove 16 from longitudinal axis 7. Height 29 corresponds largely to the radial dimension of lateral surfaces 18, 19.

Grooves 16 become wider from core 13 toward their opening. A dimension 32 in circumferential direction 15 of grooves 16 increases with increasing radial distance 26 from longitudinal axis 7. Oppositely situated lateral surfaces 18, 19 of two adjacent webs 14 are correspondingly inclined relative to one another and veer away from one another, viewed from core 13. The inclination of oppositely situated lateral surfaces 19 is preferably greater than 10 degrees, for example greater than 20 degrees, and for example less than 45 degrees. The inclination facilitates efficient rolling and forging processes.

Working section 6 by way of example has four-fold rotational symmetry about longitudinal axis 7. The four webs 14 have identical designs, and are each offset by 90 degrees with respect to their respective adjacent webs 14 in circumferential direction 15. Although four webs 14 are preferred for reasons of stability and for manufacturing, working section 6 may include at least three webs and at most eight webs. Webs 14 preferably have identical designs, in particular for an uneven number of webs. For an even number, in particular four, webs 14 may have a pairwise identical design. Webs 14 are preferably distributed equidistantly in circumferential direction 15.

Working section 6 may taper in an area 33 adjoining tip 2. Height 29 of webs 14 continuously decreases in impact direction 5, for example to a height of zero adjoining tip 2. Grooves 16 thus become increasingly flatter. Radius 23 of core 13 may be the same over entire length 12 of working section 6. Core 13 is exposed near tip 2. A length of tapered area 33 may be between one-third and one-half the length 12 of working section 6. Height 29 of webs 14 is constant in the other remaining area 34 of working section 6.

Webs 14 may be situated in parallel to longitudinal axis 7. Webs 14 may also be inclined by an inclination angle 35 relative to longitudinal axis 7. Inclination 35 may be determined, for example, based on highest point 36 of rear surface 20, of lateral surfaces 18, 19, or based on a curve of centroid of area 37 in the cross sections along longitudinal axis 7. Inclination 35 of web 14 relative to longitudinal axis 7 is preferably less than 10 degrees. Web 14 extends circumferentially over entire length 12 of working section 6 by less than 90 degrees about longitudinal axis 7.

Webs 14 illustrated by way of example have an undulated design. Web 14 includes multiple alternating counterclockwise sections 38 and clockwise sections 39 along longitudinal axis 7. Within a counterclockwise section 38, web 14 is inclined about longitudinal axis 7 in the clockwise direction; within a clockwise section 39, one web 14 is inclined in a counterclockwise direction. Inclination 35 is determined based on highest point 36, for example.

Inclination 35 of web 14 relative to longitudinal axis 7 may continuously change. The absolute value of maximum inclination 35 of web 14 with respect to longitudinal axis 7 is preferably less than 10 degrees. Webs 14 thus have left inflection points, for example in plane and right inflection points, for example in plane IV-IV. The left inflection points are preferably situated on a straight line in parallel to longitudinal axis 7; the right inflection points are preferably situated on a straight line in parallel to longitudinal axis 7. The deflections of counterclockwise sections 38 and of clockwise sections 39 in circumferential direction 15 preferably compensate for one another; i.e., the magnitudes of the deflections are equal. Web 14 extends, on average, in parallel to longitudinal axis 7. An inclination 35 averaged over length 12 of working section 6 is preferably less than 5 degrees, for example less than 2 degrees, preferably zero. In the left inflection points, web 14 is shifted with respect to itself by less than one-fourth of its width in the right inflection points in circumferential direction 15, for example by less than 15%, preferably by greater than 7%. A significant sector of grooves 16, for example greater than 50% of the cross-sectional area of groove 16, extends over entire length 12 of working section 6 in parallel to longitudinal axis 7.

What is claimed is:

1. A chisel comprising:

a tip;

a working section; and an impact surface, a longitudinal axis extending through the tip, the working section, and the impact surface, the working section including at least three webs extending along the longitudinal axis and distributed about the longitudinal axis in a circumferential direction about a core, the core having a diameter less than one half of a working section outer diameter, for at least one of the webs, a web dimension in the circumferential direction increases by at least one-third with increasing radial distance from the longitudinal axis;

wherein the at least one web includes a first lateral surface pointing in the circumferential direction, a second lateral surface pointing opposite the circumferential direction, and a rear surface pointing in a radial direction, the first lateral surface and the second lateral surface being inclined relative to one another, and the first lateral surface and the second lateral surface diverge with increasing radial distance from the longitudinal axis so that the web dimension in the circumferential direction, the web dimension in the circumferential direction being between the first lateral surface and the second lateral surface, is largest adjoining the rear surface.

2. The chisel as recited in claim 1 wherein for the at least one web, an angular web dimension about the longitudinal axis in the circumferential direction remains the same or increases with increasing distance from the longitudinal axis.

3. The chisel as recited in claim 1 wherein the first lateral surface forms at least one-sixth of the surface of the web, or the second lateral surface forms at least one-sixth of the surface of the web.

4. The chisel as recited in claim 1 wherein the webs are distributed at identical angular intervals about the longitudinal axis.

5. The chisel as recited in claim 1 wherein an inclination of the webs relative to the longitudinal axis, the inclination being inclined away from the longitudinal axis in the longitudinal direction, is less than 10 degrees.

6. The chisel as recited in claim 1 wherein the webs extend circumferentially about the longitudinal axis by less than 90 degrees.

7. The chisel as recited in claim 1 wherein the webs have at least one inclination relative to the longitudinal axis, the inclination being inclined away from the longitudinal axis in the longitudinal direction.

8. The chisel as recited in claim 7 wherein the inclination, averaged over the longitudinal axis, is less than 5 degrees.

9. The chisel as recited in claim 1 wherein a groove is situated between two adjacent webs, and in a direction radially from an outermost width of the groove toward the longitudinal axis, the groove has a continuously decreasing width in the circumferential direction.

10. The chisel as recited in claim 1 wherein the first lateral surface of a first web converges toward the second lateral surface of a second web in the direction of the longitudinal axis, wherein the first web is adjacent to the second web, and are inclined relative to one another by at least 10 degrees.

11. The chisel as recited in claim 1 wherein the web dimension in the circumferential direction is smallest at a constriction, the web dimension increasing continuously from the constriction to the largest web dimension in the circumferential direction adjoining the rear surface.

12. The chisel as recited in claim 11 wherein the largest web dimension is at least one third wider than the constriction.

13. The chisel as recited in claim 11 wherein the largest web dimension is at least one half wider than the constriction.

14. The chisel as recited in claim 1 wherein the web dimension in the circumferential direction is smallest at a constriction, and wherein the largest web dimension is at least one half wider than the constriction.

15. A chisel comprising:

a tip;

a working section; and an impact surface, a longitudinal axis extending through the tip, the working section, and the impact surface, the working section including at least three webs extending along the longitudinal axis and distributed about the longitudinal axis in a circumferential direction, for at least one of the webs, a web dimension in the circumferential direction increases by at least one-third with increasing radial distance from the longitudinal axis;

wherein the at least one web includes a first lateral surface pointing in the circumferential direction, a second lateral surface pointing opposite the circumferential direction, and a rear surface pointing in a radial direction, the first lateral surface and the second lateral surface being inclined relative to one another, and the first lateral surface and the second lateral surface diverge with increasing radial distance from the longitudinal axis so that the web dimension in the circumferential direction, the web dimension in the circumferential direction being between the first lateral surface and the second lateral surface, is largest adjoining the rear surface;

the at least one web being inclined relative to the longitudinal axis to define an inclination angle away from the longitudinal axis in the longitudinal direction.

16. A chisel comprising:

a tip;

a working section; and an impact surface, a longitudinal axis extending through the tip, the working section, and the impact surface, the working section including at least three webs extending along the longitudinal axis and distributed about the longitudinal axis in a circumferential direction about a core, a cross-sectional area of the core being less than one-third of a total cross-sectional area of the working section, for at least one of the webs, a web dimension in the circumferential direction increases by at least one-third with increasing radial distance from the longitudinal axis;

wherein the at least one web includes a first lateral surface pointing in the circumferential direction, a second lateral surface pointing opposite the circumferential direction, and a rear surface pointing in a radial direction, the first lateral surface and the second lateral surface being inclined relative to one another, and the first lateral surface and the second lateral surface diverge with increasing radial distance from the longitudinal axis so that the web dimension in the circumferential direction, the web dimension in the circumferential direction being between the first lateral surface and the second lateral surface, is largest adjoining the rear surface.

* * * * *